US007398578B2

(12) United States Patent
Lee

(10) Patent No.: US 7,398,578 B2
(45) Date of Patent: Jul. 15, 2008

(54) CYCLONE DUST COLLECTING DEVICE FOR USE IN A VACUUM CLEANER

(75) Inventor: Nam Ho Lee, Seoul (KR)

(73) Assignee: Daewoo Electronics Corporation, Seoul (KR)

( * ) Notice: Subject to any disclaimer, the term of this patent is extended or adjusted under 35 U.S.C. 154(b) by 623 days.

(21) Appl. No.: 11/012,153

(22) Filed: Dec. 16, 2004

(65) Prior Publication Data

US 2005/0138757 A1 Jun. 30, 2005

(30) Foreign Application Priority Data

| | | |
|---|---|---|
| Dec. 24, 2003 | (KR) | 10-2003-0096558 |
| Jun. 4, 2004 | (KR) | 10-2004-0040731 |
| Jun. 4, 2004 | (KR) | 10-2004-0040733 |
| Jun. 24, 2004 | (KR) | 10-2004-0047762 |
| Jun. 24, 2004 | (KR) | 10-2004-0047763 |

(51) Int. Cl.
*A47L 5/00* (2006.01)

(52) U.S. Cl. ..... 15/327.2; 15/328; 15/353; 55/337; 55/413; 55/414; 55/426; 55/429; 55/459.1

(58) Field of Classification Search ..... 15/328, 15/327.2, 353; 55/DIG. 30, 337, 413, 414, 55/426, 428, 429, 459.1
See application file for complete search history.

(56) References Cited

U.S. PATENT DOCUMENTS

| | | | | |
|---|---|---|---|---|
| 6,344,064 | B1 * | 2/2002 | Conrad | 55/337 |
| 6,440,197 | B1 | 8/2002 | Conrad et al. | |
| 6,582,489 | B2 * | 6/2003 | Conrad | 55/337 |
| 6,616,721 | B2 * | 9/2003 | Oh | 55/426 |
| 6,810,557 | B2 * | 11/2004 | Hansen et al. | 15/353 |
| 7,160,346 | B2 * | 1/2007 | Park | 55/337 |
| 2002/0088078 | A1 | 7/2002 | Oh et al. | |
| 2002/0178698 | A1 | 12/2002 | Oh et al. | |
| 2003/0106182 | A1 | 6/2003 | Lee | |

FOREIGN PATENT DOCUMENTS

| | | |
|---|---|---|
| DE | 39 30 357 A1 | 4/1991 |
| EP | 1 486 155 A | 12/2004 |
| GB | 700 791 A | 12/1953 |
| GB | 2 374 032 A | 10/2002 |
| JP | 2003-112082 | 4/2003 |
| JP | 2003-236410 | 8/2003 |
| JP | 2003-290094 | 10/2003 |
| JP | 2004-121622 | 4/2004 |
| KR | 10-2001-0001211 | 1/2001 |

* cited by examiner

*Primary Examiner*—Duane Smith
*Assistant Examiner*—Sonji Turner
(74) *Attorney, Agent, or Firm*—Bacon & Thomas PLLC

(57) ABSTRACT

A cyclone dust collecting device, for use in a vacuum cleaner, includes a housing defining therein a cyclonic air flow chamber. A dust collection chamber is disposed under the cyclonic air flow chamber and a partition wall is disposed between the cyclonic air flow chamber and the dust collection chamber. An opening and at least one ventilation hole are provided in opposite sides of the partition wall, respectively, so that a part of air and dust vortically moving in the cyclonic air flow chamber are introduced into the dust collection chamber through the opening and the air in the dust collection chamber flows back into the cyclonic air flow chamber through the ventilation hole.

10 Claims, 6 Drawing Sheets

CYCLONE DUST COLLECTING DEVICE FOR USE IN A VACUUM CLEANER

FIELD OF THE INVENTION

The present invention relates to a cyclone dust collecting device for use in a vacuum cleaner; and, more particularly, a cyclone dust collecting device capable of preventing dust from flowing back from a dust collection chamber to a cyclonic air flow chamber and making an air flow therein more smooth.

BACKGROUND OF THE INVENTION

In a conventional vacuum cleaner of a dust bag type, suctioned dust is accumulated in the dust bag made of a disposable paper. When the dust bag is filled with dust, the dust bag should be changed. Recently, there has been developed a so-called cyclone type dust collecting device in which suctioned air is spirally rotated to separate dust or the like having a relatively greater mass from the air by a centrifugal force without employing a disposable dust bag.

FIG. 6 shows a schematic cross sectional view of a conventional cyclone dust collecting device disclosed in U.S. Patent Laid-open Publication No. 2002/88078 A1.

In the conventional cyclone dust collecting device, air introduced through a suction port 925 into a cyclonic air flow chamber 923 vertically moves along the inner surface thereof. As a result, dust and the like having a relatively greater mass flows into a dust collection chamber 930 and the air is discharged from a discharge port 922 after passing through an inside of a filter unit 924.

However, in such a conventional cyclone dust collecting device, a part of air vertically moving in the cyclonic air flow chamber 923 flows into the dust collection chamber 930 to collide with dust accumulated in the dust collection chamber 930, thereby scattering the dust to flow back into the cyclonic air flow chamber 923. Further, the air flow in the cyclone dust collecting device is not smooth as a whole since there is no discharge passageway for the air introduced into the dust collection chamber 930.

SUMMARY OF THE INVENTION

It is, therefore, an object of the present invention to provide a cyclone dust collecting device capable of preventing dust accumulated in a dust collection chamber from flowing back into a cyclonic air flow chamber and making air to flow more smoothly.

In accordance with an aspect of the present invention, there is provided a cyclone dust collecting device for use in a vacuum cleaner, which comprises: a housing defining therein a cyclonic air flow chamber, the housing having a suction port communicating with the cyclonic air flow chamber; a filter assembly installed in the cyclonic air flow chamber of the housing, an inner portion of the filter assembly communicating with a discharge port; a dust collection chamber disposed under the cyclonic air flow chamber; and a partition wall disposed between the cyclonic air flow chamber and the dust collection chamber, wherein an opening and at least one ventilation hole are provided in opposite sides of the partition wall, respectively, so that a part of air and dust vertically moving in the cyclonic air flow chamber are introduced into the dust collection chamber through the opening and the air flowing in the dust collection chamber flows back into the cyclonic air flow chamber through the ventilation hole.

Preferably, a guide member is disposed under the opening, so that the air introduced into the dust collection chamber flows smoothly along an inner surface of the guide member toward the ventilation hole. Further, at least a part of the inner surface of the guide member is formed in a curved shape.

Preferably, a guide rib is extended downward from a periphery of the opening.

Preferably, a filter is installed in the ventilation hole. On the other hand, the ventilation hole may be comprised of a plurality of fine holes without the filter.

Preferably, there is provided an exhaust air guide unit to which one side end of the filter assembly is fixed, the exhaust air guide unit including an exhaust air vessel with an exhaust port, an exhaust air cover having the discharge port and a seal frame coupling the exhaust air vessel and the exhaust air cover airtightly. The exhaust air vessel is detachably installed to cover one opening side of the housing and the inner portion of the filter assembly communicates with the discharge port through the exhaust port.

Preferably, the opening is offset from an arbitrary vertical plane passing through the suction port.

Preferably, the suction port and the discharge port are disposed in parallel with each other on different axial lines.

Preferably, a cover plate is openably hinge-coupled to a bottom of the housing, wherein the dust collection plate serves as a bottom wall of the dust collection chamber.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENT

Hereinafter, a preferred embodiment of the present invention will be described with reference to the accompanying drawings.

Figure 1:
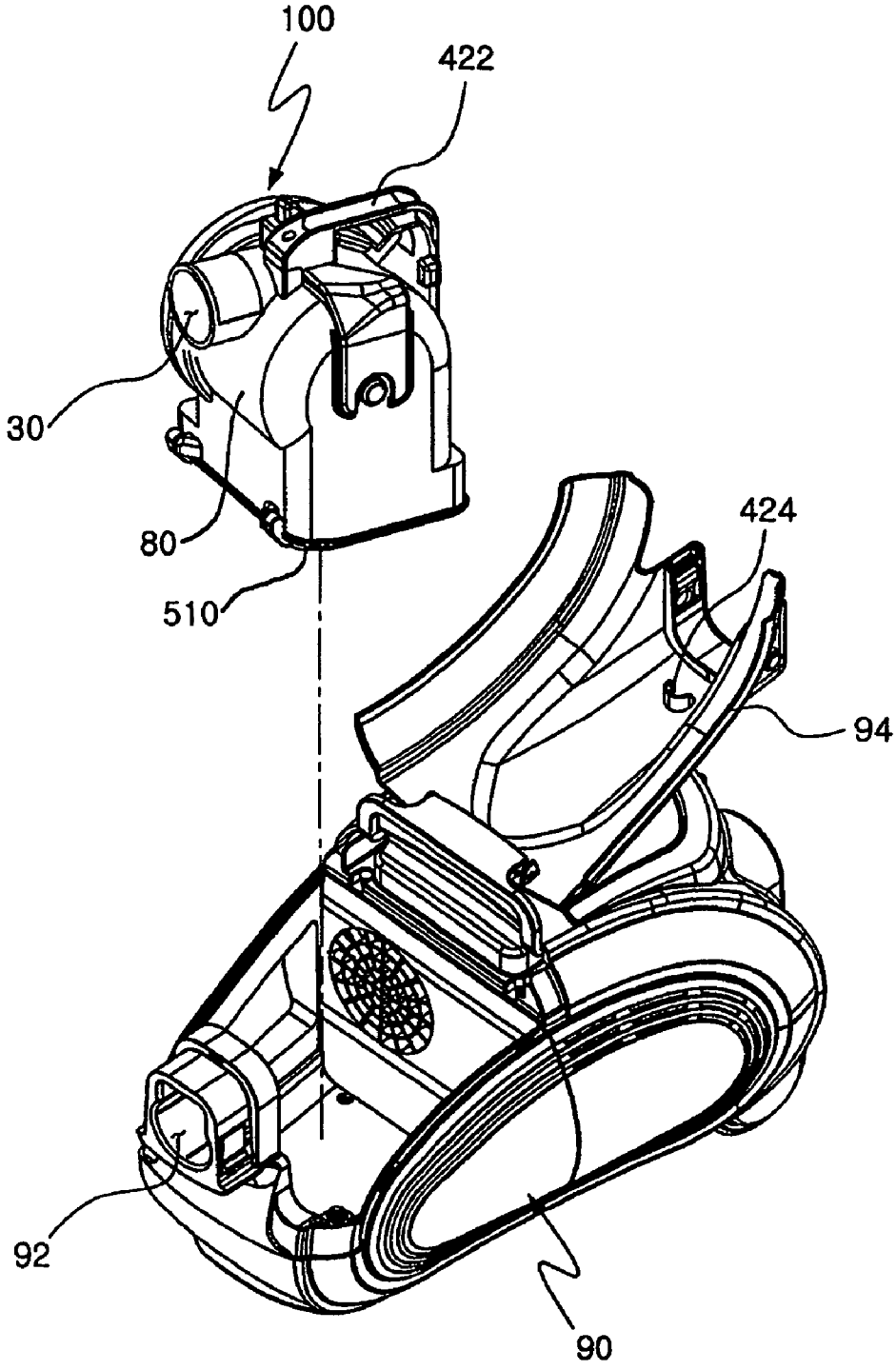
FIG. 1 provides a perspective view of a vacuum cleaner with a cyclone dust collecting device of the present invention separated from the main body of the vacuum cleaner.
Figure 2:
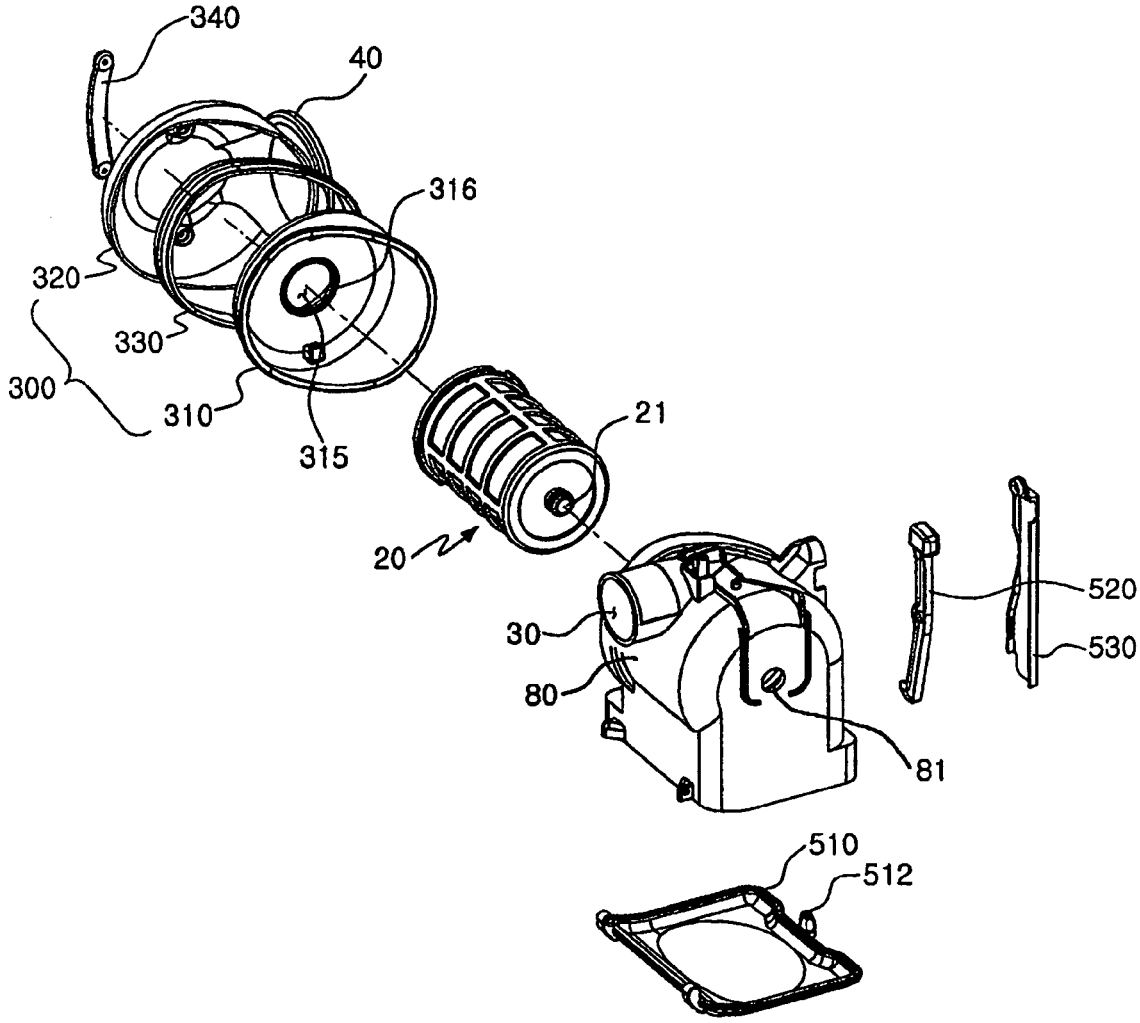
FIG. 2 shows an exploded perspective view of the cyclone dust collecting device of the present invention.
Figure 3:
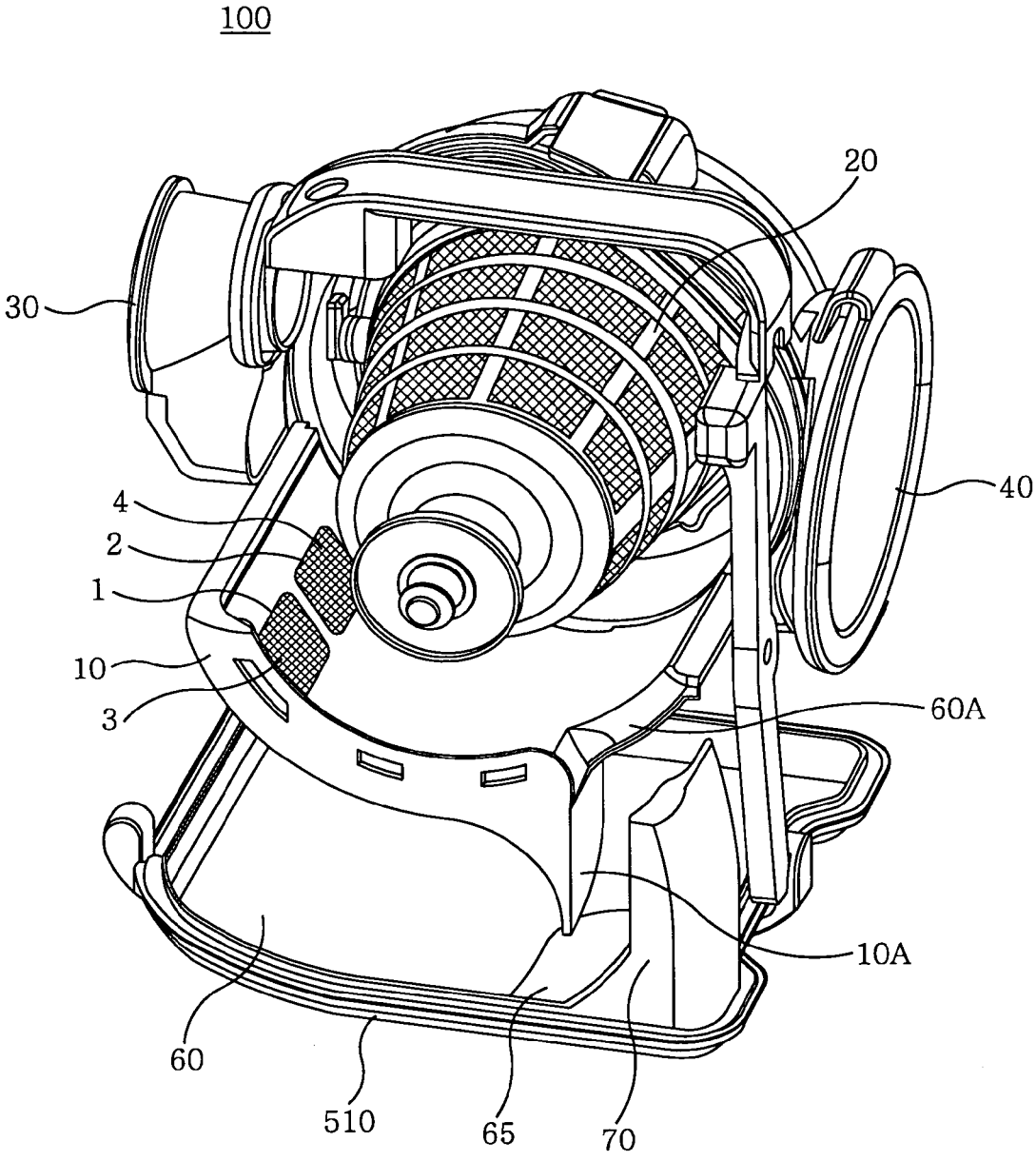
FIG. 3 describes a perspective view of the cyclone dust collecting device of the present invention with a housing thereof removed.
Figure 4:
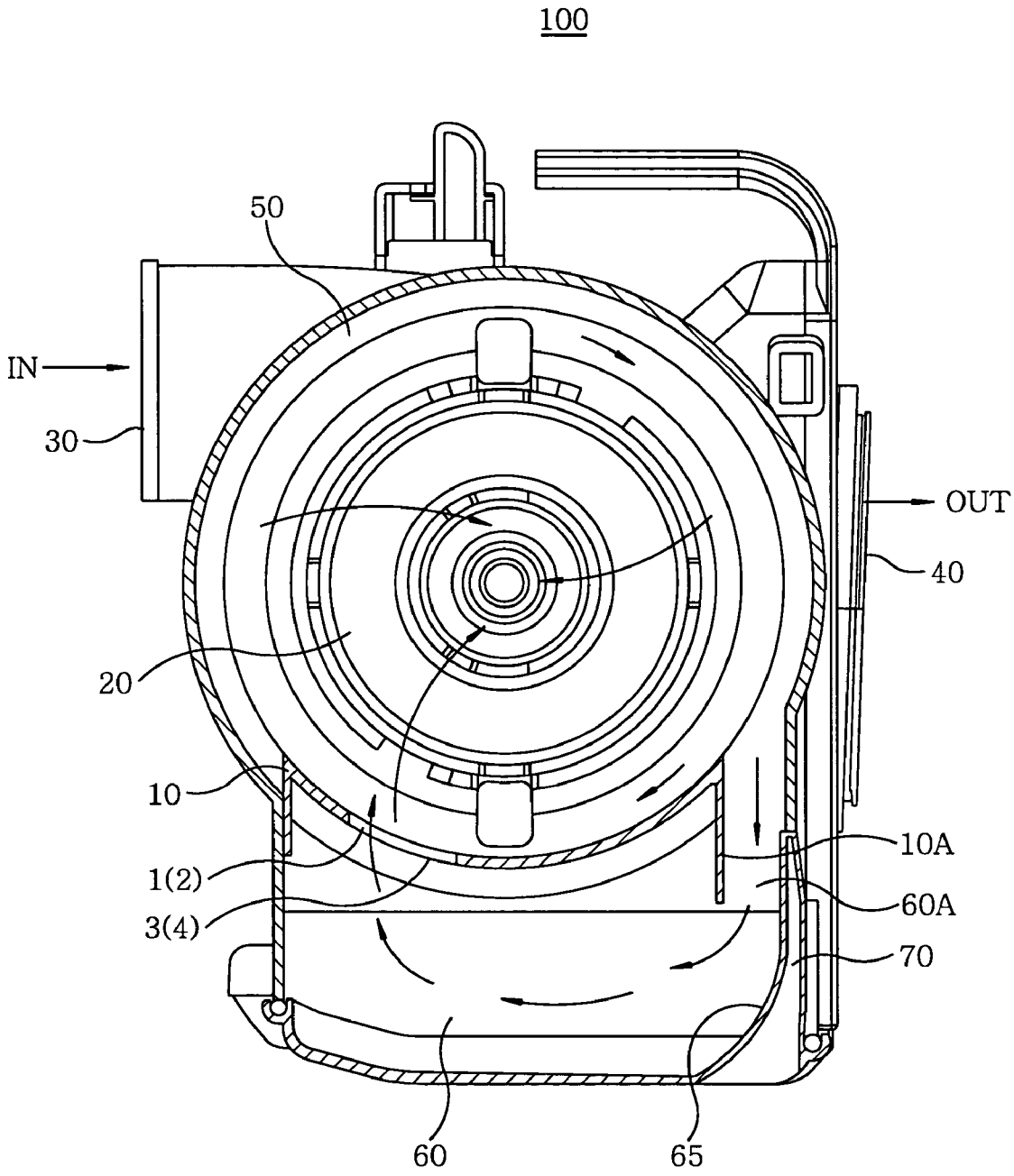
FIG. 4 sets forth a schematic cross sectional view showing an air flow in the cyclone dust collecting device of the present invention.

FIG. 1 is a perspective view of a vacuum cleaner with a cyclone dust collecting device 100 separated from a main body of the vacuum cleaner and FIG. 2 is an exploded perspective view of the cyclone dust collecting device 100 of the present invention. Further, FIG. 3 is a perspective view of the cyclone dust collecting device 100 of the present invention with a housing 80 removed and FIG. 4 is a schematic cross sectional view showing an air flow in the cyclone dust collecting device 100.

As shown in FIGS. 1 to 4, the cyclone dust collecting device 100 includes the housing 80 defining an approximately cylindrical inner space (cyclonic air flow chamber) 50 and a suction port 30 and a discharge port 40 are disposed in the front side and in the rear side of the housing 80, respectively. The suction port 30 and the discharge port 40 are preferably disposed such that air is suctioned and exhausted in an approximately parallel direction on different axial lines. Air containing dust and the like suctioned through, e.g., a suction nozzle (not shown) is introduced into the cyclonic air flow chamber 50 in the housing 80 through the suction port 30 in a tangential direction to vertically move in the cyclonic air flow chamber 50 along the inner surface thereof. A filter assembly 20 is installed in the cyclonic air flow chamber 50 such that it extends in a direction approximately orthogonal to an air suction direction. Air vertically moving in the cyclonic air flow chamber 50 passes through the filter assembly 20 to be exhausted through the discharge port 40. At this time, dust contained in the air moves along an inner wall surface of the cyclonic air flow chamber 50 to be introduced by a centrifugal force into a dust collection chamber 60 through an opening 60A or be filtered by the filter assembly 20. Accordingly, a clean air from which dust is removed is exhausted through the discharge port 40.

The dust collection chamber 60 is provided under the cyclonic air flow chamber 50 for accumulating dust therein and a partition wall 10 is disposed between the cyclonic air flow chamber 50 and the dust collection chamber 60. The opening 60A is formed in one end portion (an opposite side of the suction port 30) of the partition wall 10 and ventilation holes 1 and 2 are formed in the other end portion (the suction port 30 side) thereof. Through the opening 60A, a part of air and dust vertically moving in the cyclonic air flow chamber 50 are introduced into the dust collection chamber 60 and the air introduced into the dust collection chamber 60 flows again into the cyclonic air flow chamber through the ventilation holes 1 and 2.

Installed under the opening 60A is a guide member 70 for smoothly guiding air introduced into the dust collection chamber 60. At least a part of an inner surface 65 of the guide member 70 is formed in a curved shape. Accordingly, the air introduced into the dust collection chamber 60 through the opening 60A flows smoothly along the inner surface 65 of the guide member 70 and again into the cyclonic air flow chamber 50 through the ventilation holes 1 and 2 formed in an opposite side of the partition wall 10. Provided in the ventilation holes 1 and 2 are filters 3 and 4 for preventing dust collected in the dust collection chamber 60 from escaping through the ventilation holes 1, 2. Further, it is preferable that a guide rib 10A is extended downward from a periphery of the opening 60A in order to guide the air introduced into the dust collection chamber 60 through the opening 60A to the guide member 70. Such a guide rib 10A also has a function of preventing the dust collected in the dust collection chamber 60 from flowing back into the cyclonic air flow chamber 50 through the opening 60A. Further, it is preferable that the opening 60A is offset from an arbitrary vertical plane passing through the suction port 30 so that air and dust suctioned through the suction port 30 may be introduced through the opening 60A into the dust collection chamber 60 after vertically moving at a considerably high speed.

Referring to FIGS. 1 and 2, a cover plate 510 is openly attached to a bottom side of the housing 80. The cover plate 510 serves as a bottom wall of the dust collection chamber 60. One side end of the cover plate 510 is hinge-coupled to a bottom end of one sidewall of the housing 80 and the other side is releasably coupled to the housing 80 by a protruding portion 512 being engaged with a locking link 520.

An approximately central portion of the locking link 520 is hinge-coupled to one side surface of the housing 80 such that an upper and a lower portion of the locking link 520 are movable like a seesaw along an arbitrary vertical plane passing through the hinge point. Further, a lower end portion of the locking link 520 is releasably coupled to the protruding portion 512 of the dust collection plate 510. In case of pressing the upper portion of the locking link 520, the lower end portion thereof is released from the protruding portion 512 of the dust collection plate 510. As a result, the cover plate 510 is opened by its own weight, thereby removing dust and the like accumulated in the dust collection chamber 60 from the dust collection chamber. The locking link 520 is covered with a link cover 530.

Referring to FIG. 2, a fixing protuberance 21 on one side surface of the filter assembly 20 is inserted and fixed in a fixing hole 81 formed on a corresponding side surface of the housing 80 and the other side surface is fixed by an exhaust air guide unit 300.

The exhaust air guide unit 300 includes an exhaust air vessel 310, an exhaust air cover 320 and a seal frame 330. Formed in the exhaust air vessel 310 is an exhaust port 315 communicating with the discharge port 40. The exhaust port 315 is airtightly coupled to an air outlet (not shown) of the filter assembly 20 through a sealing ring member 316. The seal frame 330 formed of, e.g., an elastic material couples the exhaust air vessel 310 and the exhaust air cover 320 airtightly.

Furthermore, the discharge port 40 is formed in the exhaust air cover 320 such that air flowing through the filter assembly 20 and the exhaust air guide unit 300 is discharged in a direction orthogonal to a longitudinal axis of the filter assembly 20 (that is, a direction parallel to a flow direction of air introduced into the suction port 30).

The exhaust air guide unit 300 is detachably attached to the housing 80 such that the exhaust air vessel 310 covers one opening side of the cyclonic air flow chamber 50 of the housing 80. Fixed to an outer side surface of the exhaust air cover 320 is a handle 340 for use in removing the exhaust air guide unit 300 from the housing 80.

As shown in FIG. 1, a handle 422 is attached to an upper side of the cyclone dust collecting device 100 and a user holds the handle 422 and removes/inserts the cyclone dust collecting device 100 from/into a main body 90 of a vacuum cleaner such that the suction port 30 communicates with a suction-hose connector 92 of the main body 90 of the vacuum cleaner. When a cover 94 of the vacuum cleaner is closed, a pressing protrusion 424 provided on an inner surface of the cover 94 urges the handle 422 of the cyclone dust collecting device 100, so that the cyclone dust collecting device is positioned in place in the main body 90 of the vacuum cleaner.

Hereinafter, there will be described an operation of the cyclone dust collecting device 100 in accordance with the present invention.

In case a vacuum pump (not shown) installed in a rear side in the main body 90 of the vacuum cleaner is actuated, air containing dust is suctioned into the cyclonic air flow chamber 50 through a suction nozzle (not shown), a suction hose (not shown), the suction-hose connector 92 and the suction port 30. While air and dust contained therein vertically moves along the inner surface of the cyclonic air flow chamber 50, dust having a relatively greater mass introduced into the dust collection chamber 60 through the opening 60A by a centrifugal force. The air spirally moving in the cyclonic air flow chamber 50 passes through the filter assembly 20 and is exhausted from the discharge port 30, during which dust that is not introduced into the dust collection chamber 60 is filtered by a filter of the filter assembly 20.

Meanwhile, a part of air vortically moving in the cyclonic air flow chamber 50 is introduced into the dust collection chamber 60 through the opening 60A. The air introduced into the dust collection chamber 60 smoothly flows along the inner surface 65 of the guide member 70 and flows back into the cyclonic air flow chamber 50 through the ventilation holes 1 and 2 formed in the partition wall 10. At this time, dust accumulated in the dust collection chamber 60 flows together with the air flowing in the dust collection chamber 60 toward a place far from the opening 60A. The filters 3 and 4 are respectively installed in the ventilation holes 1 and 2, thereby preventing the dust accumulated in the dust collection chamber 60 from flowing back into the cyclonic air flow chamber 50 while allowing the air to pass therethrough. In this way, dust accumulated in the dust collection chamber 60 is shifted together with the air flowing toward ventilation holes 1, 2 therein, thereby preventing the dust from flowing back into the cyclonic air flow chamber 50 through the opening 60A.

In case of discharging the dust accumulated in the dust collection chamber 60, the cover 94 of the vacuum cleaner is opened and the cyclone dust collecting device 100 is then removed from the main body 90 of the vacuum cleaner. Thereafter, the protruding portion 512 of the dust collection plate 510 is released from the locking link 520 by pressing the upper portion of the locking link 520. By doing so, the dust collection plate 510 is opened by its own weight and the dust accumulated in the dust collection chamber 60 drops down.

Furthermore, in case of removing dust filtered by the filter assembly 20 and attached thereto, the exhaust air guide unit 300 and the filter assembly 20 fixed thereto are separated from the cyclone dust collecting device 100 after releasing the fixing protuberance 21 inserted and fixed in the fixing hole 81 of the housing 80 of the cyclone dust collecting device 100. In this state, the dust attached to the filter assembly 20 and the dust in the cyclonic air flow chamber 50 can easily be removed.

Figure 5:
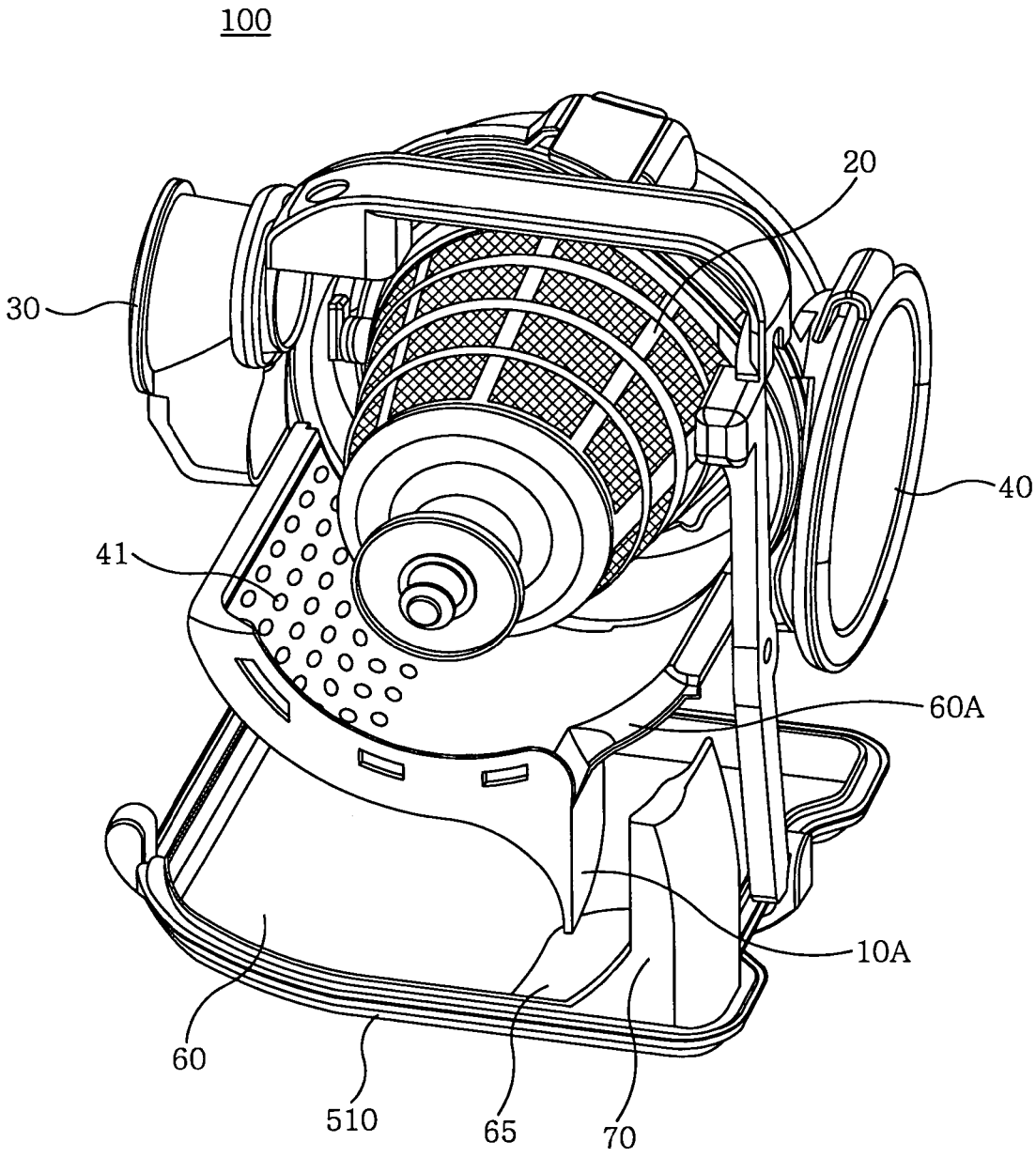
FIG. 5 shows a modification of the cyclone dust collecting device of the present invention.
Figure 6:
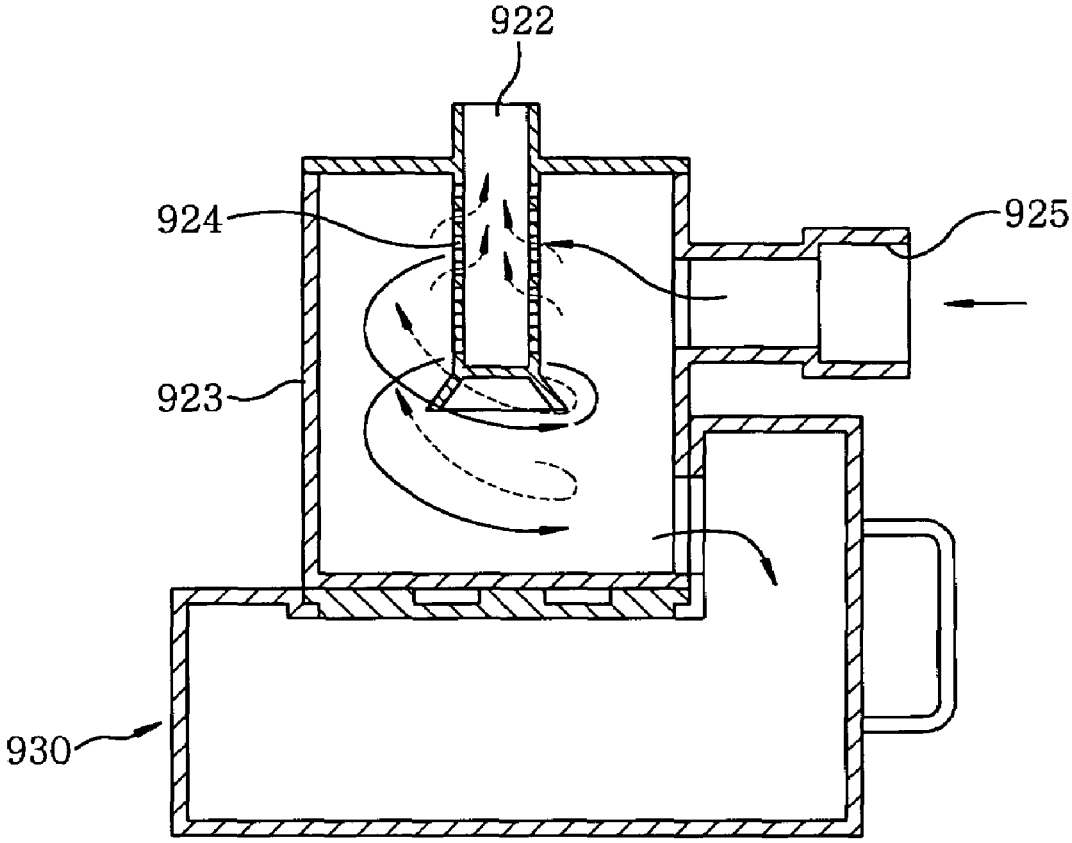
FIG. 6 (PRIOR ART)
FIG. 6 illustrates a schematic cross sectional view of a conventional cyclone dust collecting device.

In the above embodiment, there has been described and shown that the ventilation holes 1, 2 are formed in the partition wall 10 and that the filters 3, 4 are installed in the respective ventilation holes 1, 2. However, as shown in FIG. 5, a plurality of fine holes 41 having a size for allowing air to pass therethrough while preventing dust from escaping therethrough can be formed instead of the ventilation holes 1, 2 and the filters 3, 4.

As described above, according to the cyclone dust collecting device of the present invention, the dust accumulated in the dust collection chamber is prevented from flowing back into the cyclonic air flow chamber and the air flow therein becomes more smooth.

While the invention has been shown and described with respect to the preferred embodiments, it will be understood by those skilled in the art that various changes and modifications may be made without departing from the spirit and scope of the invention as defined in the following claims.

What is claimed is:

1. A cyclone dust collecting device for use in a vacuum cleaner, which comprises:

a housing defining therein a cyclonic air flow chamber, the housing having a suction port communicating with the cyclonic air flow chamber;

a filter assembly installed in the cyclonic air flow chamber of the housing, an inner portion of the filter assembly communicating with a discharge port;

a dust collection chamber disposed under the cyclonic air flow chamber; and a partition wall disposed between the cyclonic air flow chamber and the dust collection chamber, wherein an opening and at least one ventilation hole are provided in opposite sides of the partition wall, respectively, so that a part of air and dust vortically moving in the cyclonic airflow chamber are introduced into the dust collection chamber through the opening and the air flowing in the dust collection chamber flows back into the cyclonic air flow chamber through the ventilation hole.

2. The device of claim 1, wherein a guide member is disposed under the opening, so that the air introduced into the dust collection chamber flows smoothly along an inner surface of the guide member toward the ventilation hole.

3. The device of claim 2, wherein at least a part of the inner surface of the guide member is formed in a curved shape.

4. The device of claim 1, further comprising a guide rib extended downward from a periphery of the opening.

5. The device of claim 1, wherein a filter is installed in the ventilation hole.

6. The device of claim 1, wherein the ventilation hole is comprised of a plurality of fine holes.

7. The device of claim 1, further comprising an exhaust air guide unit to which one side end of the filter assembly is fixed, the exhaust air guide unit including an exhaust air vessel with an exhaust port, an exhaust air cover having the discharge port and a seal frame coupling the exhaust air vessel and the exhaust air cover airtightly, wherein the exhaust air vessel is detachably installed to cover one opening side of the housing and the inner portion of the filter assembly communicates with the discharge port through the exhaust port.

8. The device of claim 1, wherein the opening is offset from an arbitrary vertical plane passing through the suction port.

9. The device of claim 1, wherein the suction port and the discharge port are disposed in parallel with each other on different axial lines.

10. The device of claim 1, further comprising a dust collection plate openably hinge-coupled to a bottom of the housing, wherein the dust collection plate serves as a bottom wall of the dust collection chamber.

* * * * *